US010632604B2

(12) United States Patent
Perron et al.

(10) Patent No.: US 10,632,604 B2
(45) Date of Patent: Apr. 28, 2020

(54) MAGAZINE WITH LOCKBACK PUSHER FOR USE WITH STAPLING DEVICE

(71) Applicant: Black & Decker Inc., New Britain, CT (US)

(72) Inventors: Donald R. Perron, North Smithfield, RI (US); Jonathan W. Fairbanks, Coventry, RI (US)

(73) Assignee: Black & Decker Inc., New Britain, CT (US)

( * ) Notice: Subject to any disclaimer, the term of this patent is extended or adjusted under 35 U.S.C. 154(b) by 282 days.

(21) Appl. No.: 15/884,600

(22) Filed: Jan. 31, 2018

(65) Prior Publication Data

US 2019/0232477 A1 Aug. 1, 2019

(51) Int. Cl.
*B25C 5/16* (2006.01)
*B25C 5/15* (2006.01)

(52) U.S. Cl.
CPC ..... *B25C 5/162* (2013.01); *B25C 5/15* (2013.01); *B25C 5/1696* (2013.01)

(58) Field of Classification Search
CPC ..... B25C 5/162; B25C 5/1696; B25C 5/15
USPC ..... 227/175.1–182.1, 119–152
See application file for complete search history.

(56) References Cited

U.S. PATENT DOCUMENTS 3,907,190 A * 9/1975 Mitsuhashi ..... B25C 5/0214 227/127
4,182,474 A * 1/1980 Sato ..... B25C 5/1693 227/120
4,801,062 A 1/1989 Austin
4,903,880 A 2/1990 Austin et al.
5,433,367 A * 7/1995 Liu ..... B25C 5/162 227/120
5,692,667 A * 12/1997 Chi ..... B25C 5/025 227/134
5,813,588 A 9/1998 Lin
6,186,386 B1 2/2001 Canlas et al.
7,296,720 B2 * 11/2007 Kirby ..... B25C 5/025 116/201
7,641,089 B2 1/2010 Schell et al.
8,006,883 B2 8/2011 Schell et al.
8,453,903 B2 * 6/2013 Marks ..... B25C 5/11 227/132
8,690,036 B2 4/2014 Schell et al.
8,899,460 B2 12/2014 Wojcicki
9,643,305 B2 5/2017 Gregory et al.
(Continued)

*Primary Examiner* — Robert F Long
(74) *Attorney, Agent, or Firm* — Harness, Dickey & Pierce, P.L.C.

(57) ABSTRACT

A fastener magazine of a fastening device may include a track defining an elongated channel with a dispensing end at which fasteners are dispensed from the magazine. A runner positioned in the track may include a release member that projects outward from an outer surface of the runner. A pusher may be positioned in the track and coupled to the runner such that the pusher exerts a force in a direction toward the dispensing end of the track on the fasteners when the runner is in a closed position. A retention member that is attached to a side wall of the track can engage the pusher through an aperture in the track to prevent the pusher from contacting the fasteners until the runner has reached a desired position in the track. The release member can contact the retention member to disengage the retention member from the pusher.

27 Claims, 8 Drawing Sheets

(56) References Cited

U.S. PATENT DOCUMENTS

| | | | | |
|---|---|---|---|---|
| 2007/0057012 | A1* | 3/2007 | Kandasamy | B25C 5/0242 227/134 |
| 2010/0012701 | A1* | 1/2010 | Huang | B25C 5/0207 227/132 |
| 2010/0059568 | A1* | 3/2010 | Leung | B25C 5/025 227/64 |
| 2011/0309126 | A1* | 12/2011 | Zolentroff | B25C 5/0242 227/128 |
| 2015/0076204 | A1* | 3/2015 | Maltais | B25C 5/1617 227/120 |
| 2019/0351537 | A1* | 11/2019 | Chou | B25C 5/1696 |

* cited by examiner

MAGAZINE WITH LOCKBACK PUSHER FOR USE WITH STAPLING DEVICE

FIELD

The present disclosure relates to magazines with lockback pushers for use on stapling devices.

BACKGROUND

This section provides background information related to the present disclosure which is not necessarily prior art.

Various types of fastening devices such as staplers, nailers and the like often include magazines that store a row of staples, nails or other fasteners. The staples, nails or other fasteners can be joined together and arranged in a stick of collated fasteners so that the stick of collated fasteners can be inserted into the magazine of the fastening device as a single unit. The magazines include a pusher that forces the staples, nails or other fasteners into a deployment position, typically at the end of the magazine. In this deployment position a lead staple, nail or other fastener is aligned with a staple driver so that the lead staple, nail or other fastener can be ejected from the fastening device to secure a workpiece in a desired location.

Existing magazines suffer from drawbacks that cause the staples, nails or other fasteners to be improperly positioned such that the fastener is not properly aligned with the staple driver and cannot be deployed by the fastening device. In some existing magazines, the pusher can cause one or more of the staples, nails or other fasteners of the row of fasteners in the magazine to buckle when the pusher exerts a force on the row of fasteners to move the fasteners toward the deployment position. This condition can often occur when the magazine is loaded with fasteners. Existing magazines can also be difficult or time consuming to load with fasteners. There is a need, therefore, for an improved magazine and pusher device that resolves these and other drawbacks of existing designs.

SUMMARY

This section provides a general summary of the disclosure, and is not a comprehensive disclosure of its full scope or all of its features.

In accordance with one aspect of the present disclosure, a fastener magazine of a fastening device may include a track defining an elongated channel with an opening through which a plurality of fasteners are insertable into the track. The track may include a dispensing end at which the plurality of fasteners are dispensed from the magazine and a distal end located opposite to the dispensing end. The fastener magazine may also include a runner slidingly received in the track. The runner may include a release member that projects outward from an outer surface of the runner. The runner can be movable in the track between an open position and a closed position wherein the runner covers the opening to retain the plurality of fasteners in the track when the runner is in the closed position. The fastener magazine may also include a pusher slidingly positioned in the track. The pusher may be coupled to the runner via a biasing member such that the pusher exerts a force in a direction toward the dispensing end of the track on the plurality of fasteners when the runner is in the closed position and the plurality of fasteners is inserted into the channel. The fastener magazine may also include a retention member connected to a side wall of the track. The retention member can engage the pusher through an aperture in the track to prevent the pusher from contacting the plurality of fasteners until the runner has reached a desired position between the distal end and the dispensing end. The release member can contact the retention member when the runner is at the desired position to disengage the retention member from the pusher.

In accordance with another aspect of the present disclosure, a staple magazine of a stapling device may include an elongated track with a longitudinal channel for receiving a stick of collated staples therein. The staple magazine may also include a runner slidingly received in the track. The runner can include a cover panel for covering the channel. The staple magazine may also include a staple pusher slidingly positioned in the track between the runner and the track and having a lock surface extending substantially transverse to a longitudinal direction of the track. The staple magazine may also include a retention member carried by the track. The retention member can have an opposing lock surface engagable with and extending substantially parallel to the lock surface of the staple pusher to retain the staple pusher in a locked position relative to the track. The staple magazine may also include a release member carried by the runner. The release member can have a release surface engageable against the retention member to cause the opposing lock surface to disengage the lock surface of the staple pusher and release the staple pusher from the locked position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
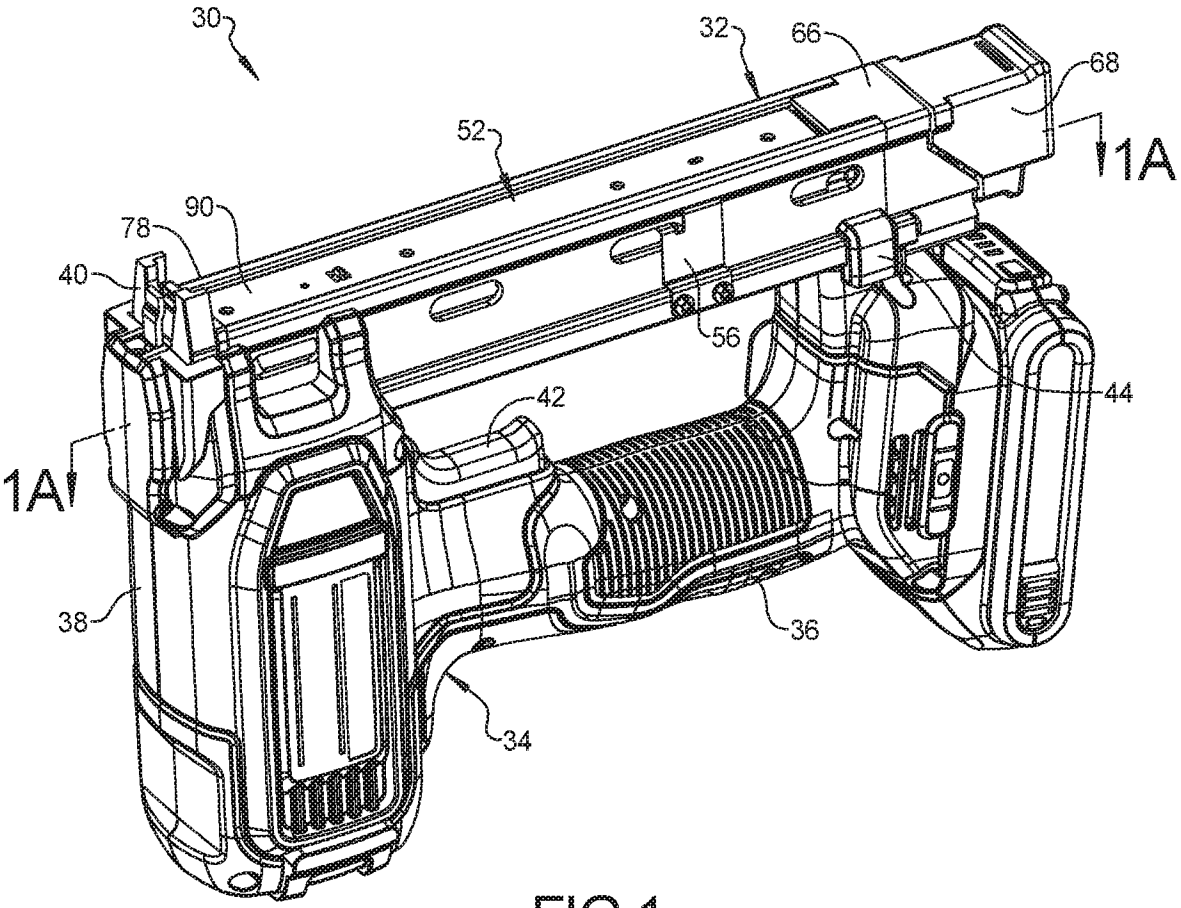
FIG. 1 is a perspective view of one example fastening device incorporating a magazine in accordance with the present disclosure.

FIG. 1 shows one example fastening device 30 in accordance with the present disclosure. As will be further described below, the fastening device 30 includes a magazine 32 that holds a plurality of fasteners that are dispensed from the fastening device 30 with sufficient energy to penetrate a workpiece (not shown). As shown, the example fastening device 30 is a battery-powered stapler with a magazine 32 that holds a plurality of staples. As can be appreciated, the principles, technologies and structures described herein can also be used on other fastening devices including electric or pneumatic staplers, nailers and the like.

Referring back to FIGS. 1, 1A and 2, the fastening device 30 includes a body portion 34 that holds the magazine 32. The body portion 34 can include a handle 36, a trigger 42 and a power unit 38 that ejects fasteners from the magazine 32 at a nose 40. An operator of the fastening device 30 can place the nose 40 at a desired location and depress the trigger 42 causing a fastener to be ejected at the desired location.

Figure 2:
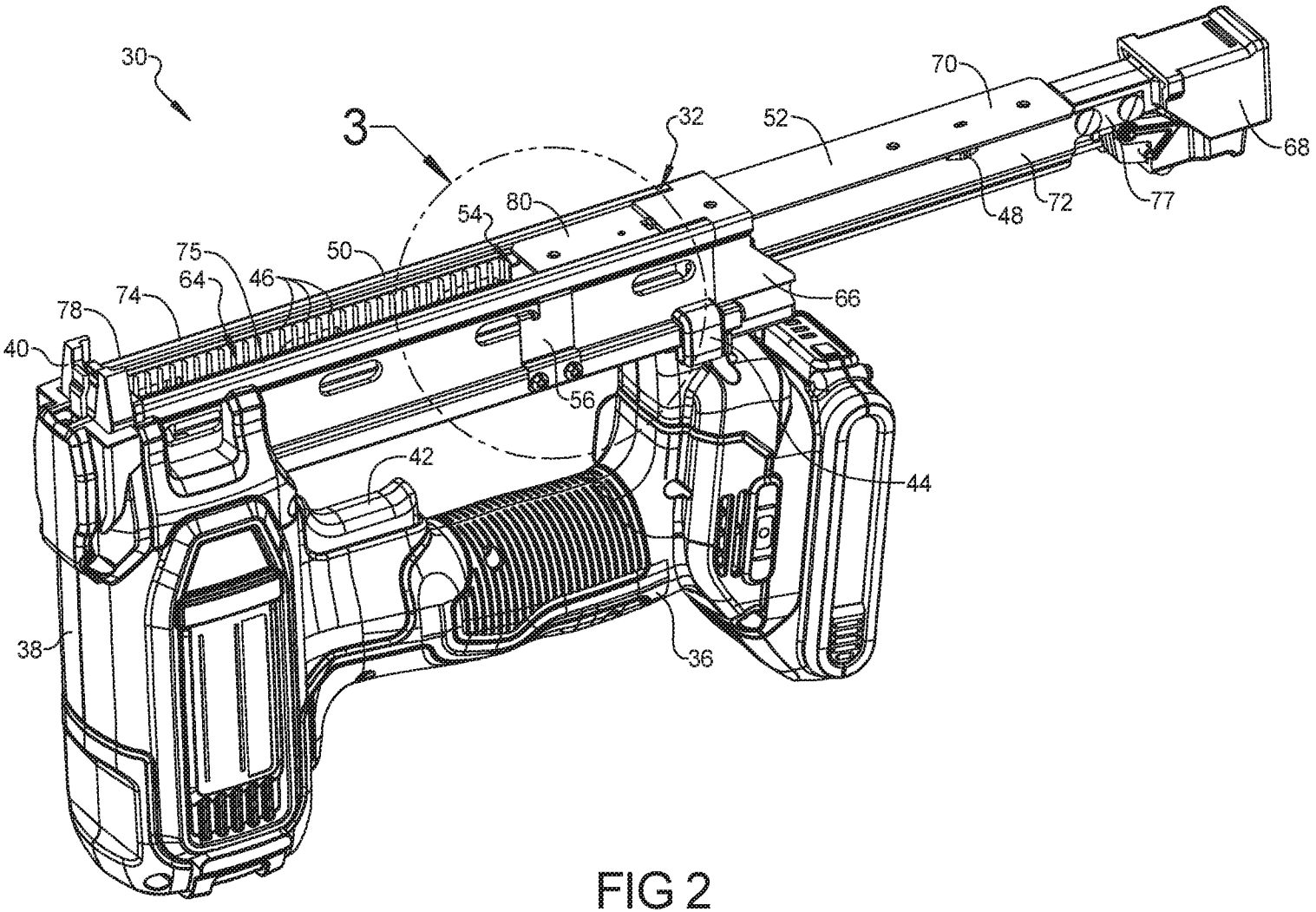
FIG. 2 is a perspective view of the example fastening device of FIG. 1 shown with the magazine in an open position.

The magazine 32 is an elongated receptacle that extends from the nose 40 on the power unit 38 to a lower portion 44 of the handle 36. In other examples, the magazine 32 can be positioned differently on the fastening device 30 but generally extends away from the nose 40. The magazine 32 holds a plurality of fasteners that are moved toward the nose 40 as the fasteners are ejected from the nose 40. As shown in FIG. 2, a plurality of fasteners 46 can be inserted into the magazine 32 when the magazine is in an open position. The fasteners 46 can be joined together as a stick of collated fasteners and inserted into the magazine 32. When the fasteners 46 are positioned inside the magazine 32, the magazine 32 can be moved to the closed position as shown in FIG. 1. In the closed position, the fasteners 46 are retained inside the magazine 32 and are moved toward the nose 40 until all or most of the fasteners 46 have been ejected and the magazine 32 needs to be re-loaded with more fasteners 46.

The magazine 32 includes a track 50, a runner 52, a pusher 54 and a retention member 56. The track 50 is secured between the power unit 38 and the lower portion 44 of the handle 36. The track 50 includes a first wall 58 that is separated from a second wall 60 by a base 62. In this manner, the track 50 has a rectangular shape that defines a channel 64 that is located between the first wall 58 and the second wall 60. The track 50 is suitably shaped so as to receive the fasteners 46. In the example shown, the fasteners 46 are staples so the track 50 has a width and depth to hold the fasteners 46 and move the fasteners 46 toward the nose 40. In one example, the track 50 is extruded from a suitable metal such as aluminum. In other examples, the track 50 can be otherwise formed, shaped or molded from other materials into the desired shape to hold the dispense the fasteners 46. Such other materials can include other metals, alloys, plastics, composites and the like.

The track 50 can also include an end cap 66. The end cap 66, in the example shown, is a separate piece that is inserted into the end of the track 50 away from the nose 40. The end cap 66 can be secured to the track 50 by an interference fit or can have a locking tab or other feature that engages the track 50 to retain the end cap 66 to the track 50. In other examples, the end cap 66 can be integrally formed with the track 50.

The end cap 66, as will be explained further below, can interact with a locking grip 68 that is located on the runner 52. The locking grip 68 releasably connects to the end cap 66 to lock the runner 52 in the closed position. The locking grip 68 and the end cap 66 can have cooperating locking features that permit the locking grip 68 to connect to the end cap 66 when the runner 52 is inserted into the track 50 such that the locking grip 68 is positioned adjacent to or inside the end cap 66.

The runner 52 can be received into the track 50. The runner 52 can slide within the track 50 along the elongated (or longitudinal) direction of the track 50. The runner 52 of this example is sized with a cross-sectional profile that is similar to the cross-sectional profile of the track 50 in that the runner 52 can slide along the track 50 from the closed position (FIG. 1) to the open position (FIG. 2). In the example shown, the runner 52 includes a cover panel 70 and a beam 72. The cover panel 70 is a rectangular planar member that fits inside two rails on the track 50. The cover panel 70 has a width (a distance in the transverse direction) that extends between a first rail 74 and a second rail 75 on the track 50. As such, the cover panel 70 can cover the channel 64 when the cover panel 70 is slid along the first rail 74 and the second rail 75 to a position adjacent to the nose 40. When the cover panel 70 of the runner 52 is slid along the first rail 74 and the second rail 75 away from the nose 40, the cover panel exposes the channel 64 such that the fasteners 46 can be inserted into the track 50.

The cover panel 70 can be connected to the beam 72. The beam 72 is an elongated bar that is sized to fit inside the track 50. In this example, the beam 72 has a rectangular cross-section and has a width that is smaller than the inside width of the fasteners 46. In this manner, the beam 72 can be nested adjacent to the fasteners 46 to limit the fasteners 46 from moving in the track 50 when the magazine 32 is in the closed position. In the closed position, the fasteners 46 are positioned inside the track 50 with the first wall 58, the second wall 60 and the base 62 located adjacent the outer profile of the fasteners 46. The beam 72 is nested inside the legs of the fasteners 46.

Figure 3:
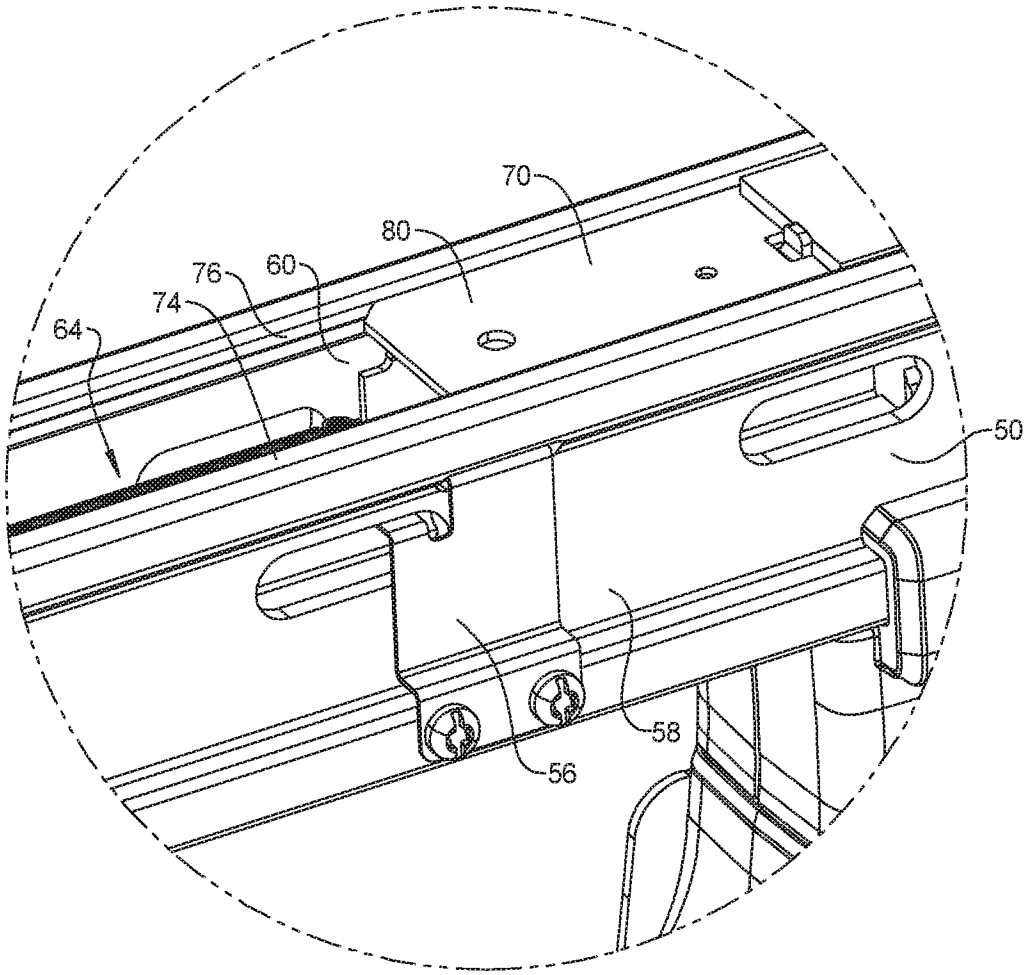
FIG. 3 is magnified view of FIG. 2 showing one example of various lockback pusher components in accordance with the present disclosure.
Figure 4:
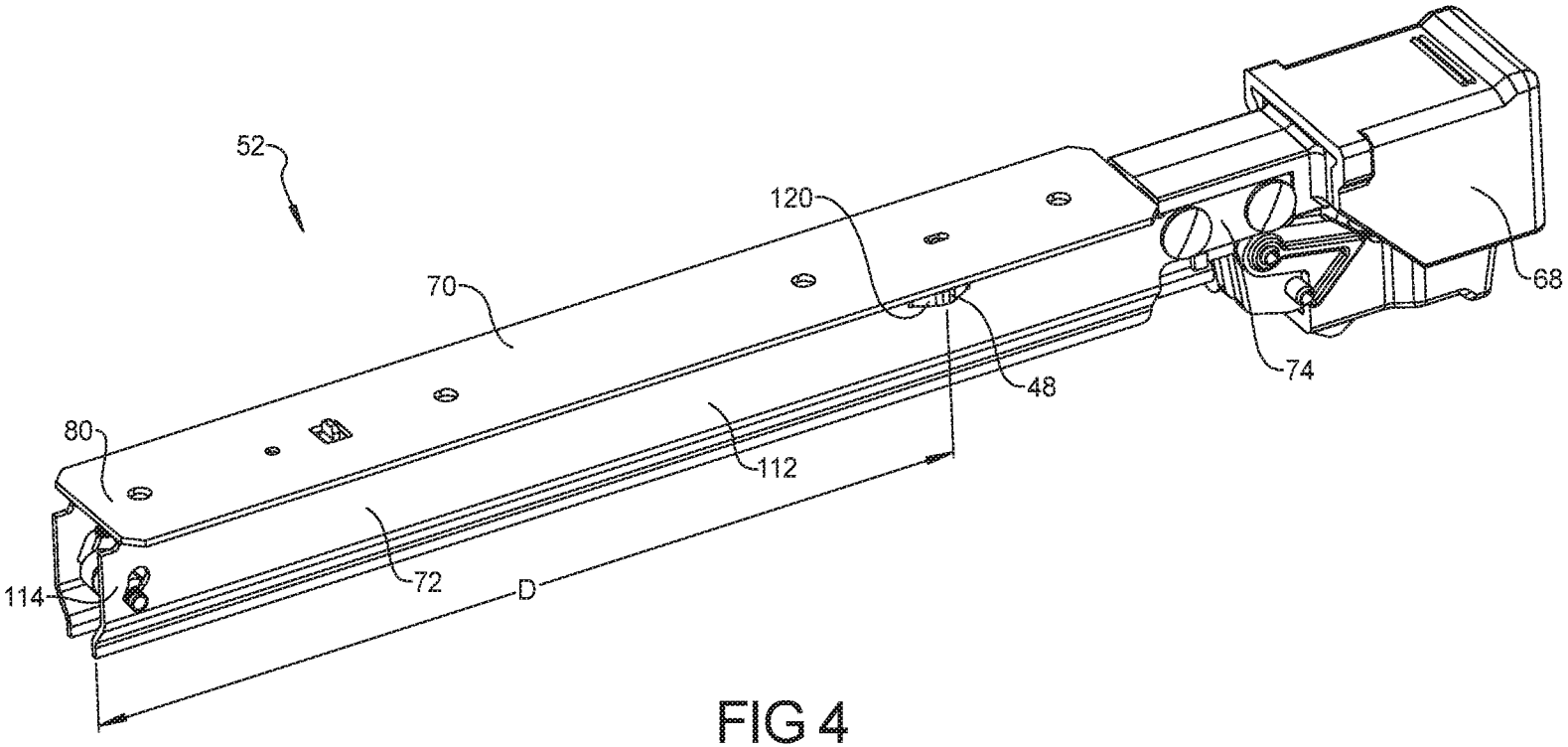
FIG. 4 is a perspective view of one example runner separate from the fastening device of FIG. 1.

As shown in FIGS. 1-3, the locking grip 68 is connected to a terminating end 77 of the beam 72. To move the magazine 32 to the closed position, the locking grip 68 is pushed toward the nose 40 to slide the runner 52 along the track 50 until the locking grip 68 engages the end cap 66 and is secured the runner 52 in a position with the cover panel 70 covering the opening between the first wall 58 and the second wall 60 in the track 50.

The runner 52 can also include a release member 48. The release member 48 of this example is fixed on a side surface 112 of the beam 72. The release member 48 can be a projection or other formation that projects outward from the side surface 112 of the beam 72. In the example shown, the release member 48 is strip of material that has been bowed outward from the beam 72 to create the rounded arcuate shape as shown. The release member 48 can include a release surface 120 that is shaped and vertically positioned relative to the retention member 56 to interact with a release arm 104 of the retention member 56 as will be further explained below. The release surface 120 can be angled relative to the longitudinal direction of the runner 52 such that release surface 120 can cause the retention member 56 to move away from the side surface 112 of the beam 72 and/or in a direction transverse to the longitudinal direction on the beam. In other examples, the release member 48 can be a dome-shaped dimple that is formed in the beam 72. In still other examples, the release member 48 can be the head of a fastener that is secured in the beam 72.

The release member 48 can be positioned at a distance D from a leading end 114 of the runner 52. As will be described further below, the release member 48 interacts with the retention member 56 via a release surface 120, for example, to release the pusher 54 from a locked state when the runner 52 is in a desired position in the track 50. For example, it can be desirable that the runner 52 is positioned at or near the dispensing end 78 of the track 50 before the pusher 54 is released from the locked state to a released state so that the fasteners 46 that are inserted in the track 50 do not buckle flex or are otherwise displaced from the track 50 before the runner 52 is moved to the closed position to retain the fasteners 46 in position. As such, the release member 48 is positioned at the distance D on the runner 52 to cause the pusher to be released from the locked state when the runner 52 is at a desired position relative to the track 50. Thus, the pusher can be prevented from prematurely engaging a stick of fasteners before they are properly aligned and/or seated in the magazine.

Referring now to FIGS. 1A, 7A, 7B and 7C, the pusher 54 is positioned inside the track 50 and can slide along the track 50 in the space between the runner 52 and the track 50 which is the space the fasteners 46 can also occupy. In this position, the pusher 54 can contact the fasteners 46. The pusher 54 is connected to the runner 52 by a biasing member 76. The biasing member 76 exerts a force on the pusher 54 to bias the pusher 54 toward the dispensing end 78 of the track 50 adjacent to the nose 40. The pusher 54 is biased toward the dispensing end 78 of the track 50 so that the released pusher 54 can exert a force on the fasteners 46 to urge the fasteners to move along the track 50 toward the dispensing end 78. In this manner, the pusher 54 pushes the fasteners 46 toward the dispensing end 78 so that the fasteners 46 can be ejected by the power unit 38 at the nose 40.

In the example shown, the biasing member 76 is a coil spring that is connected at a front portion 80 of the runner 52 and to the pusher 54. When the runner 52 is positioned fully inside the track 50 with the locking grip 68 engaged to the end cap 66, the biasing member 76 is in an extended state such that the pusher 54 is pulled toward the dispensing end 78 of the track 50 to pusher the fasteners 46 toward the nose 40 as previously described.

The pusher 54, in the example shown, has a U-shaped cross-sectional profile that partially surrounds the runner 52. The pusher 54 includes a first side 82, a second side 84 and a cross support 86. The first side 82 and the second side 84 are coupled to each other by the cross support 86. The width of the pusher 54, or the space between the first side 82 and the second side 84, is larger than the width of the beam 72 of the runner 52 so that the runner 52 can fit between the first side 82 and the second side 84.

Figure 7A:
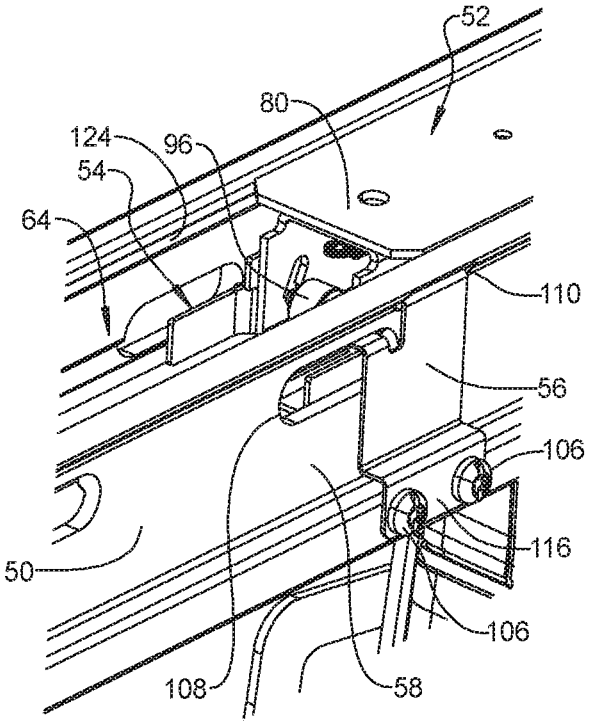
FIG. 7A is a magnified view of the example fastening device of FIG. 1 showing various lockback pusher components.
Figure 7C:
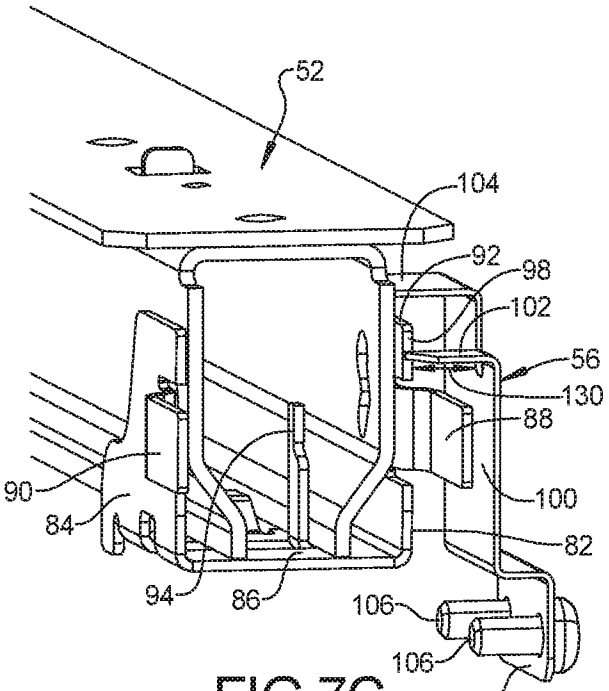
FIG. 7C is another magnified view of FIG. 7B showing the engagement of the pusher to the retention member without the track from a different angle.
Figure 7B:
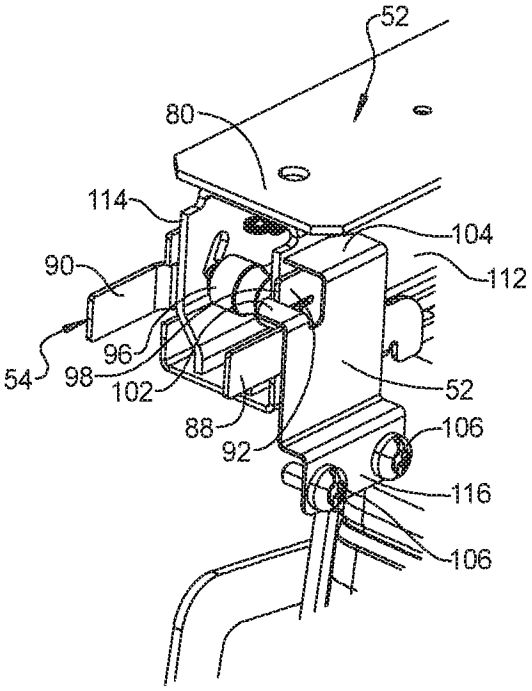
FIG. 7B is the magnified view of FIG. 7A showing the engagement of the pusher to the retention member without the track.

The pusher 54, in the example shown, also includes a first wing 88, a second wing 90, an engagement tab 92 and a pull arm 94. The first wing 88 and the second wing 90 project away from the first side 82 and the second side 84 from a front region of the pusher 54. The first wing 88 and the second wing 90 are offset from the first side 82 and the second side 84, respectively, such that the width between the first wing 88 and the second wing 90 is larger than the width between the first side 82 and the second side 84. The first wing 88 and the second wing 90 can nest around the fasteners 46 when the pusher 54 is pushing the fasteners 46 toward the dispensing end 78, The pull arm 94, in the example shown, is a length of material that is connected to the cross support 86 between the first side 82 and the second side 84. When the pusher 54 is installed in the track 50, the pull arm 94 projects into the beam 72 of the runner 52. As shown in FIGS. 7A and 7B, the runner 52 can include a roller 96 that is connected to the beam 72 at the front portion 80 of the runner 52. The pull arm 94 projects upward in the beam 72 such that the roller 96 contacts the pull arm 94 when the runner 52 is moved away from the dispensing end 78 of the track 50. In this manner, the roller 96 pulls the pusher 54 away from the dispensing end 78 by pulling on the pull arm 94. Thus, when the runner 52 is pulled away from the dispensing end 78, the pusher 54 is also pulled away from the dispensing end 78 to expose the channel 64 so that fasteners 46 can be installed into the track 50.

The engagement tab 92, in the example shown, is a projection on the pusher 54 that can have a lock surface 98 that engages with an opposing lock surface 118 on the retention member 56 to lock the pusher 54 in a retracted or locked position as will be described. The engagement tab 92, in the example shown, is a rectangular projection of material that extends from the first side 82 toward the front of the pusher 54 in a similar direction to that of the first wing 88.

The lock surface 98 can be a forward-facing surface of the engagement tab 92. The lock surface 98, in the example shown, is a surface that is substantially normal to the longitudinal direction of the track 50. In other words, the lock surface 98 can extend substantially transverse to the longitudinal direction of the track 50. In this orientation, the lock surface 98 on the pusher 54 and the opposing lock surface 118 on the retention member 56 can abut one another to lock the pusher 54 at a retracted position in the track 50. In such a position, the pusher can be prevented from moving toward the dispensing end 78 of the track 50 unless the opposing lock surface 118 is disengaged from the lock surface 98.

Figure 5:
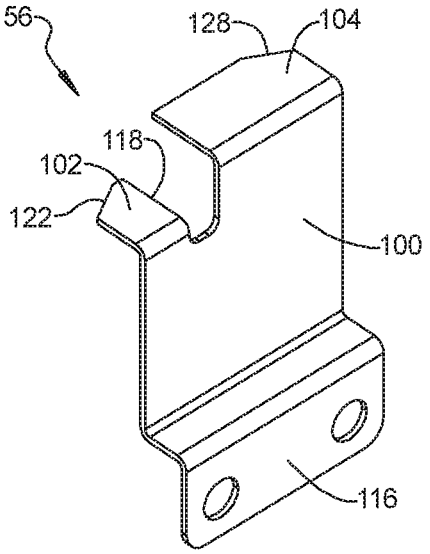
FIG. 5 is perspective view of the retention member of the example fastening device of FIG. 1.
Figure 6:
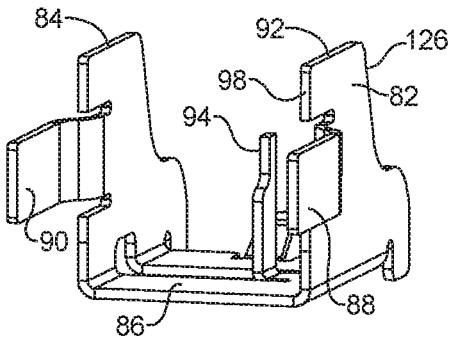
FIG. 6 is a perspective view of the pusher of the example fastening device of FIG. 1.

As further shown in FIG. 5, the pusher 54 can also include a bypass surface 122. In the example shown, the bypass surface 122 is positioned on a forward portion of the engagement tab 92. The bypass surface 122 can assist in transitioning the pusher 54 from the released position in which the opposing lock surface 118 is disengaged from the lock surface 98 to a locked position in which the opposing lock surface 118 is engaged to the lock surface 98. In the example shown, the bypass surface 122 is an angled surface that is angled at an oblique angle relative to the longitudinal direction of the track 50. In this orientation, when an opposing bypass surface 126 that is located on the rear (or trailing) end of the pusher 54 contacts the bypass surface 122, the opposing bypass surface 126 causes the lock arm 102 of the retention member 56 to move away from the track 50. This movement of the retention member 56 causes a distance 130 (see FIG. 7C) to increase such that the pusher 54 can translate along the track 50 to a position behind (or longitudinally away from dispensing end 78) the lock arm 102 or the retention member 56. This movement enables the pusher 54 to move from the released position to the locked position.

In other examples, the pusher 54 can include a second engagement tab that extends from the second side 84. In still other examples, the engagement tab 92 can have other shapes or profiles from that described above.

As shown in FIGS. 6, 7A, 7B and 7C, the magazine 32 also includes the retention member 56. The retention member 56, in the example shown, is connected to an outer surface of the first wall 58 of the track 50. The retention member includes a support wall 100, a lock arm 102, a release arm 104 and a connecting portion 116. The support wall 100 is a vertical wall of the retention member 56 and is connected to the connecting portion 116. The connecting portion 116 is offset from the support wall 100 and is connected to the track 50. In the example shown, the retention member 56 is connecting using two fasteners 106. In other examples, the retention member 56 can be connected to the track 50 using other connecting methods such as welding, staking or the like.

The lock arm 102, in the example shown, is a tab of material having the opposing lock surface 118 that is oriented substantially perpendicular to the longitudinal direction of the channel 64 (i.e., in the transverse direction). The lock arm 102 projects inward from the support wall 100 and through a first aperture 108 in the track 50 such that the lock arm 102 extends into the channel 64. The lock arm 102 can extend into the channel 64 and engage the lock surface 98 of the engagement tab 92 of the pusher 54 when the pusher 54 is pulled away from the dispensing end 78 of the track 50. In this manner, the lock arm 102 can lock the pusher 54 in a retracted position and limit the pusher 54 from moving toward the dispensing end 78 of the track 50 when the lock arm 102 is engaging the engagement tab 92 of the pusher 54.

The release arm 104 of the retention member 56 can be another tab of material that is oriented substantially perpendicular to the support wall 100 or substantially perpendicular to the longitudinal direction of the track 50 (i.e., the transverse direction). Like the lock arm 102, the release arm 104 can project inward from the support wall 100 through a second aperture 110 in the first wall 58 of the track 50. The release arm 104 has a width (i.e., the distance that the release arm 104 projects inward form the support wall 100) such that the release arm 104 contacts or rests adjacent to a side surface 112 of the beam 72. The release arm 104 is positioned, in this example, at a vertical location relative to the base 62 of the track 50 that is different from a vertical location of the lock arm 102. As shown in the orientation of the magazine 32 in FIGS. 7A, 7B, 7C and 8, the release arm 104 is positioned at a vertical location that is above the vertical location of the lock arm 102. This relative positioning of the lock arm 102 and the release arm 104 permits the lock arm 102 to engage the engagement tab 92 and the release arm 104 to be positioned above the pusher 54 in the track 50 and adjacent the side surface 112 of the beam 72.

In the example shown, the release arm 104 is spaced apart from the lock arm 102. The release arm 104 is positioned on a side of the retention member 56 away from the dispensing end 78 of the track 50. In other examples, the release arm 104 can have different shapes or profiles.

Figure 8:
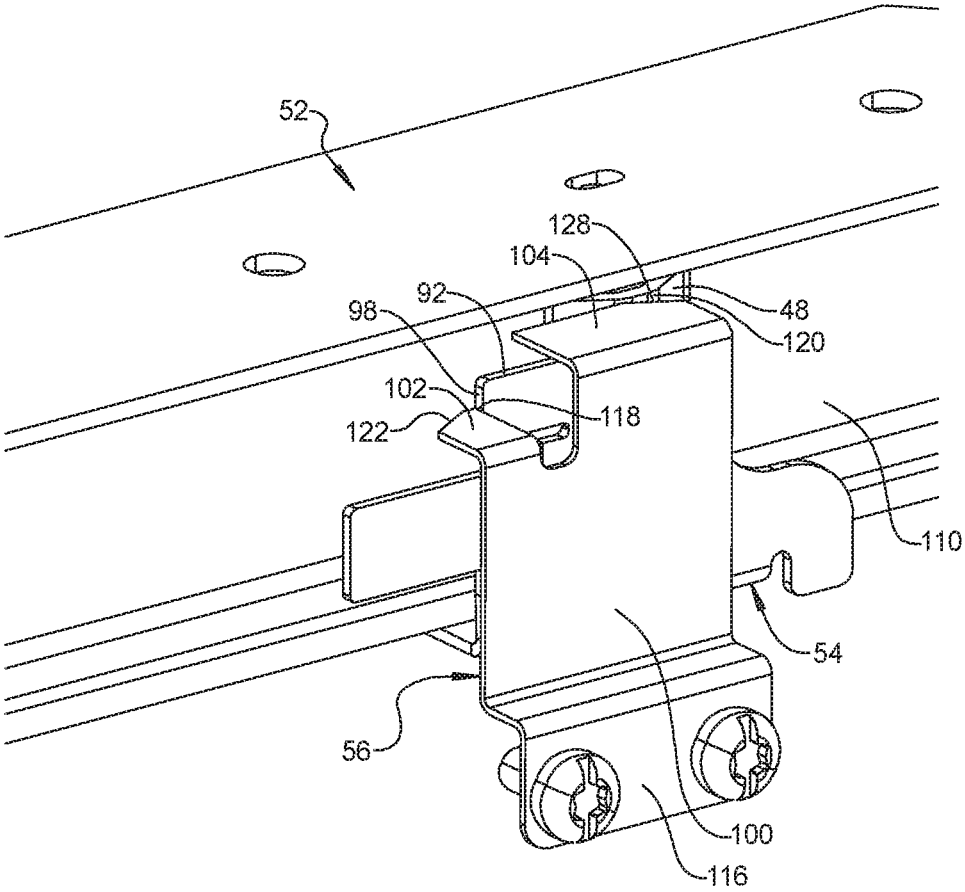
FIG. 8 is another magnified view of the example fastening device showing the engagement of the pusher to the retention member just prior to the release of the pusher.

As further shown in FIGS. 5 and 8, the release arm 104 can include an opposing release surface 128. The opposing release surface 128, in the example shown, is angled at an oblique angle relative to the longitudinal direction of the track 50. The opposing release surface 128 can contact the release surface 120 of the runner 52 when the runner 52 is moved to a position in which the runner 52 is at or near the dispensing end of the track 50 as previously described. The angled surface of the opposing release surface 128 can assist in causing the retention member 56 to move away from the track 50 when the release member 48 engages the release arm 104. As this occurs, the distance 130 increases and permits the lock arm 102 to disengage from the engagement tab 92.

The retention member 56, in this example, is formed of spring steel and is a separate element that is connected to the track 50 such that it can flex away from the track 50 as will be described. In other examples, other materials and configurations can be used. For example, the retention member 56 can be formed, machined or molded as part of the track 50. In still other examples, the retention member can be made of a suitable other metal, alloy, plastic or composite material.

The operation of the example magazine 32 will now be described in more detail. As shown in FIG. 1, the magazine 32 can operate in the closed position. In the closed position, the runner 52 is secured in position with the locking grip 68 engaged to the end cap 66 of the track 50. This position of the runner 52 causes the cover panel 70 to cover the opening 124 of the channel 64 of the track 50 to keep the fasteners 46 retained in the track 50.

As the fastening device 30 is used by an operator, the power unit 38 ejects the fasteners 46 from the track 50 at the nose 40. When the fasteners 46 are dispensed from the fastening device 30, the operator can choose to reload the track 50 with additional fasteners 46. To reload the fastening device 30, the operator moves the magazine 32 from the closed position (FIG. 1) to the open position (FIG. 2).

To move the magazine 32 from the closed position to the open position, an operator grips the locking grip 68 and disengages the locking grip 68 from the end cap 66. The operator can then move the runner 52 in a longitudinal direction relative to the track 50 by pulling the runner 52 away from the dispensing end 78 of the track 50. This action causes the beam 72 and the cover panel 70 to move away from the dispensing end 78 of the track 50 and to expose the opening 124 of the channel 64 (see FIG. 7A).

As this occurs, the roller 96 in the runner 52 contacts the pull arm 94 of the pusher 54. The pull arm 94 pulls the pusher 54 away from the dispensing end 78 of the track 50 with the runner 52. The pusher 54 continues to move away from the dispensing end 78 of the track 50 with the runner 52.

As the runner 52 and the pusher 54 move away from the dispensing end 78 of the track 50, the pusher 54 encounters the lock arm 102 of the retention member 56. When the opposing bypass surface 126 of the pusher 54 encounters the bypass surface 122 of the lock arm 102, the retention member 56 flexes outward and away from the first wall 58 of the track 50. This cantilevered movement of the retention member 56 permits the pusher 54 with the engagement tab 92 to pass between the retention member 56 and the beam 72.

After the engagement tab 92 of the pusher 54 passes the lock arm 102, the retention member 56 flexes back toward the first wall 58 of the track 50. In this position, the lock surface 98 of the pusher 54 is engaged by the opposing lock surface 118 of the lock arm 102. The pusher 54, in this position, is in a locked state because the pusher 54 is restricted from moving toward the dispensing end 78 of the track 50 because the engagement tab 92 contacts the lock arm 102 as shown in FIGS. 7A-C.

When the pusher 54 is in the locked state, the magazine 32 is also in the open position as shown in FIG. 2. In the open position, the channel 64 is exposed. The operator can load the fasteners 46 into the track 50 as desired. After the fasteners 46 are positioned in the track 50, the operator can then begin to move the runner 52 to the closed position.

The operator moves the runner 52 toward the dispensing end 78 of the track 50. As this occurs, the beam 72 and the cover panel 70 move toward the dispensing end 78 of the track 50 and begin to cover the channel 64. As this occurs, the biasing member 76 that is connected between the runner 52 and the pusher 54 begins to exert a force on the pusher 54 in a direction toward the dispensing end 78 of the track 50.

In existing magazines without the lockback pusher 54 of the present disclosure, the pusher would move toward the dispensing end 78 of the track 50 and contact the fasteners 46 in the track 50. The pusher, in such existing systems, would not be limited from moving toward the dispensing end 78 of the track 50 with the runner 52. In such existing magazines without the lockback pusher 54 of the present disclosure, the pusher 54 can prematurely engage the fasteners 46 and cause the fasteners 46 to be flexed, buckled or otherwise displaced from a seated position in the track 50. The operator has to re-insert the dislodged or buckled fasteners 46 before the magazine can be closed.

In contrast, in the example magazine 32 of the present disclosure, the pusher 54 is retained in a locked state by the retention member 56 as the runner 52 moves to the closed position. While the runner 52 is being inserted, the force from the biasing member 76 is not prematurely exerted on the fasteners 46 because the pusher 54 is retained in the locked state by the lock arm 102 of the retention member 56.

When the runner 52 is at a desired position relative to the track 50, the release member 48 causes the pusher 54 to move to a released state in which the pusher 54 is permitted to move within the track 50 and engage the fasteners 46. As the runner 52 is moved toward the dispensing end 78, the release member 48 also moves toward the pusher 54. The release arm 104 of the retention member 56 is positioned against or adjacent to the side surface 112 of the beam 72. When the opposing release surface 128 of the release arm 104 encounters the release surface 120 of the release member 48 (as shown in FIG. 8), the release arm 104 causes the retention member 56 to flex outward away from the first wall 58 of the track 50. As this occurs, the lock arm 102 of the retention member 56 also moves outward and away from the engagement tab 92 of the pusher 54.

The height of the release member 48 (i.e., the distance that the release member 48 projects outward from the side surface 112) is sufficient to cause the lock arm 102 to move outward and away from the engagement tab 92 of the pusher 54 to allow the pusher 54 to move toward the dispensing end 78 of the track 50 after it has been assured that the fasteners are properly seated and aligned in the channel. Thus, the release member 48 causes the retention member 56 to move a sufficient distance 130 such that the opposing lock surface 118 of the lock arm 102 disengages from the lock surface 98 of the pusher 54 to move the pusher from the locked state to the released state. In the released state, the force exerted by the biasing member 76 pulls the pusher 54 toward the dispensing end 78 and past the lock arm 102. In the released state, the pusher 54 engages the fasteners 46 and can push the fasteners toward the dispensing end 78 of the track 50.

Figure 1A:
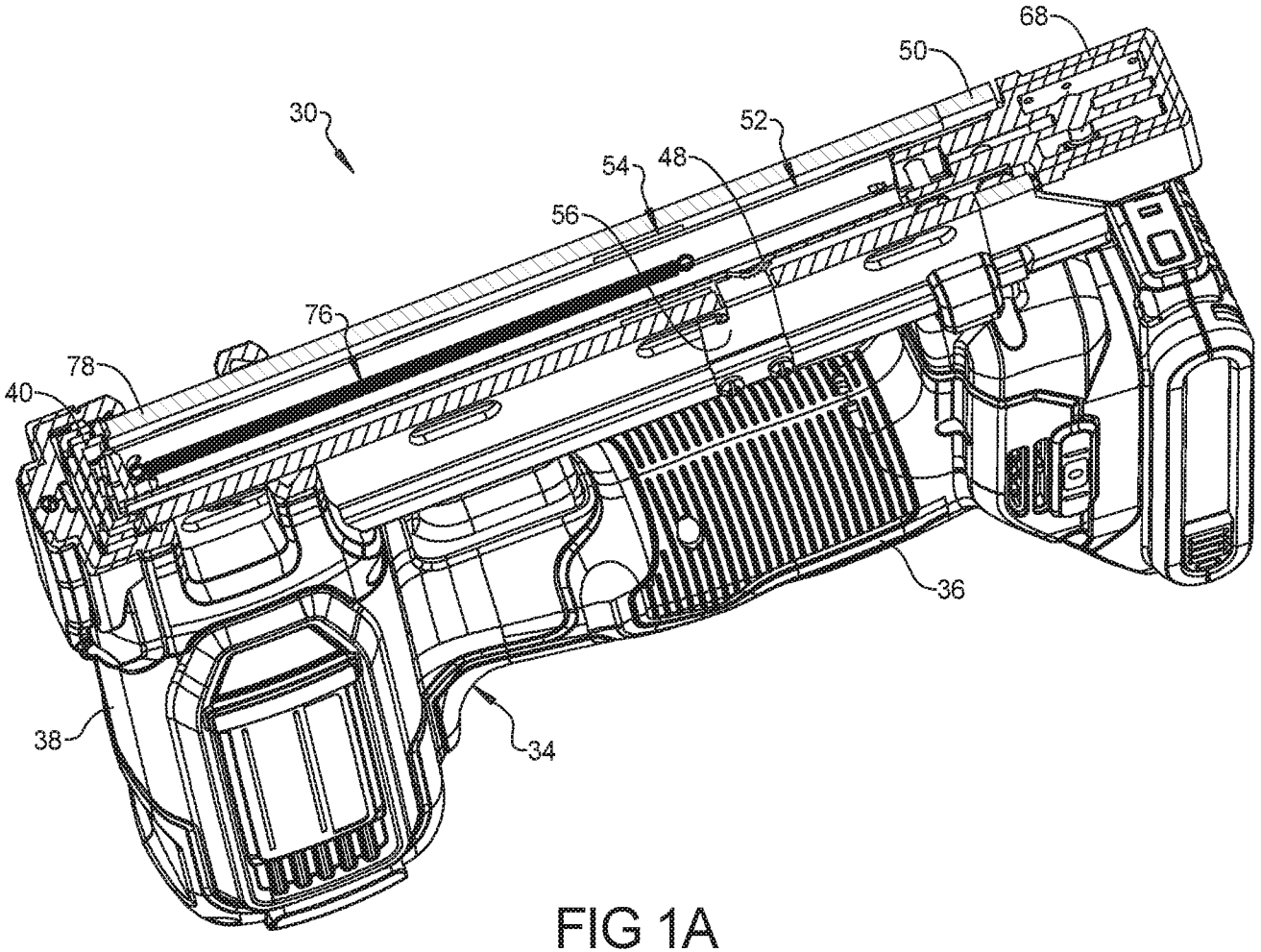
FIG. 1A is a sectional view of the example fastening device of FIG. 1.

In the example shown, the release member 48 is positioned at the distance D to cause the pusher 54 to move to the released state when the leading end 114 of the runner 52 is positioned close or adjacent to the dispensing end 78 of the track 50. Since the cover panel 70 is covering substantially all of the channel 64 and the beam 72 is positioned over the fasteners 46, the force of the pusher 54 that is exerted on the fasteners 46 does not cause the fasteners to flex, buckle or become dislodged from the track 50. In one example, the leading end 114 of the runner 52 is positioned about 1-2 mm from the dispensing end 78 of the track 50 when the release member 48 moves the pusher to the released state. In another example, the leading end 114 of the runner 52 is located in the range of 1 to 10 mm away from the dispensing end 78 when the release member 48 moves the pusher 54 to the released state. In such positions and as shown in FIG. 1A, for example, the release member 48 can remain engaged to the retention member 56 when the runner 52 is in the closed position or when the runner is in the latched position (i.e., when the locking grip 68 is engaged to the end cap 66). In still other examples, the desired position of the runner 52 relative to the track 50 can be other relative distances when the release member 48 moves the pusher to the released state.

Numerous specific details are set forth such as examples of specific components, devices, and methods, to provide an understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Terms such as "first," "second," and other numerical terms when used herein do not imply a sequence or order unless clearly indicated by the context. Similarly, spatially relative terms, such as "inner," "outer," "beneath," "below," "lower," "above," "upper," and the like, are used herein for ease of description to describe one element or feature's relationship to another element(s) or feature(s) as illustrated in the figures. Spatially relative terms are intended to encompass different orientations of the device in addition to the orientation depicted in the figures.

The foregoing descriptions of the example embodiments and example applications have been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fastener magazine of a fastening device comprising:

a track defining an elongated channel with an opening through which a plurality of fasteners are insertable into the track, the track including a dispensing end at which the plurality of fasteners are dispensed from the magazine and a distal end located opposite to the dispensing end;

a runner slidingly received in the track and including a release member that projects outward from an outer surface of the runner, the runner movable in the track between an open position and a closed position, the runner covering the opening to retain the plurality of fasteners in the track when the runner is in the closed position;

a pusher slidingly positioned in the track, the pusher coupled to the runner via a biasing member such that the pusher exerts a force in a direction toward the dispensing end of the track on the plurality of fasteners when the runner is in the closed position and the plurality of fasteners is inserted into the channel; and a retention member connected to a side wall of the track, the retention member engaging the pusher through an aperture in the track to prevent the pusher from contacting the plurality of fasteners until the runner has reached a desired position between the distal end and the dispensing end, the release member contacting the retention member when the runner is at the desired position to disengage the retention member from the pusher.

2. The magazine of claim 1 wherein the desired position is located closer to the dispensing end than the distal end.

3. The magazine of claim 1 wherein the desired position corresponds to a position of the runner in which the runner covers the opening except for a longitudinal gap of 1 to 10 mm.

4. The magazine of claim 1 wherein the retention member is only connected to the track at one end of the retention member such that the retention member is cantilevered.

5. The magazine of claim 1 wherein the retention member is secured to the track at a vertical end portion of the retention member that is vertically spaced apart from the pusher and the runner such that the retention member flexes away from the track when contacted by the pusher.

6. The magazine of claim 1 wherein the retention member includes a support wall and a lock arm, the support wall positioned against the side wall of the track and the lock arm projecting away from the support wall through the aperture to engage the pusher in the channel.

7. The magazine of claim 6 wherein the lock arm contacts the pusher between the track and the runner.

8. The magazine of claim 7 wherein the retention member includes a release arm that projects away from the support wall and into the channel of the track, the release member contacting the release arm to move the lock arm away from the pusher to disengage the lock arm from the pusher when the runner is positioned at the desired position.

9. The magazine of claim 8 wherein the lock arm and the release arm project inward into the channel at different vertical heights whereby the lock arm contacts the pusher and the release arm is vertically spaced apart from the pusher.

10. A battery-powered stapler including the magazine of claim 1.

11. A magazine for use on a stapling device, the magazine comprising:

an elongated track including a longitudinal channel for receiving a stick of collated staples therein;

a runner slidingly received in the track, the runner including a cover panel for covering the channel and a release member projecting laterally outward from an outer surface of the runner inside the channel;

a retention member connected to the track, the retention member being flexible relative to the track such that the retention member moves laterally toward and away from the track; and a pusher slidingly positioned in the track between the runner and the track, the pusher having a locked state in which the retention member engages and restricts the pusher from moving along the track and the pusher having a released state in which the retention member disengages the pusher allowing the pusher to urge the stick of collated staples along the track; and wherein the release member engages the retention member to laterally move the retention member out of engagement with the pusher to permit the pusher to move from the locked state to the released state.

12. The magazine of claim 11 wherein the pusher is moved from the locked state to the released state when the runner is moved longitudinally in the track to a position in which the release member contacts the retention member and causes the retention member to flex away from the pusher.

13. The magazine of claim 11 wherein the runner pulls the pusher past the retention member when the runner is moved longitudinally in the track to expose the channel, the pusher causing the retention member to flex away from the pusher and then engage the pusher when the pusher moves past the retention member to permit the pusher to move from the released state to the locked state.

14. The magazine of claim 12 wherein the release member is spaced apart from the pusher such that the release member does not contact the pusher when the runner is moved in the track.

15. The magazine of claim 14 wherein the pusher is moved from the released state to the locked state in order to prevent a force exerted by the pusher on the stick of collated staples from causing undesirable movement of the stick of collated staples when the runner is moved relative to the track.

16. The magazine of claim 15 wherein the pusher has a U-shaped cross sectional profile that nests around the runner in the track.

17. The magazine of claim 11 wherein:

the retention member includes a lock arm and a release arm, the lock arm projecting through a first side wall of the track at a first vertical height and the release arm projecting through the first side wall of the track at a second vertical height; and the release member is positioned at the second vertical height to engage release arm of the retention member to laterally move the lock arm out of engagement with the pusher to permit the pusher to move from the locked state to the released state.

18. The magazine of claim 17 wherein the pusher has a vertical height that is greater than the first vertical height but less than the second vertical height such that the lock arm engages the pusher but the release arm does not engage the pusher.

19. The magazine of claim 18 wherein the pusher has a u-shaped cross-sectional profile that nests inside the track.

20. A staple magazine of a stapling device, the staple magazine comprising:

an elongated track including a longitudinal channel for receiving a stick of collated staples therein;

a runner slidingly received in the track, the runner including a cover panel for covering the channel;

a staple pusher slidingly positioned in the track between the runner and the track and having a lock surface extending substantially transverse to a longitudinal direction of the track;

a retention member carried by the track, the retention member having an opposing lock surface engagable with and extending substantially parallel to the lock surface of the staple pusher to retain the staple pusher in a locked position relative to the track; and a release member carried by the runner, the release member having a release surface engageable against the retention member to cause the opposing lock surface to disengage the lock surface of the staple pusher and release the staple pusher from the locked position.

21. The staple magazine of claim 20 wherein at least one of the release surface and the retention member extends at a release angle such that engagement between the release surface and the retention member increases a distance between the pusher and the retention member allowing the lock surface and opposing lock surface to disengage each other and release the staple pusher from the locked position.

22. The staple magazine of claim 21 wherein the distance extends substantially transverse to the longitudinal direction of the track.

23. The staple magazine of claim 20 wherein at least one of the staple pusher and the retention member has a bypass surface extending at a bypass angle such that engagement between the staple pusher and the retention member at the bypass surface increases a distance between the pusher and the retention member allowing the lock surface to slide along a surface of the pusher until the distance is able to decrease allowing the lock surface and opposing lock surface to engage each other and retain the staple pusher in the locked position.

24. The staple magazine of claim 23 wherein the bypass surface is on a front side of a transversely extending lock arm of the retention member, and the opposing lock surface is on a rear side of the transversely extending lock arm.

25. The staple magazine of claim 24 wherein the distance extends substantially transverse to the longitudinal direction of the track.

26. The staple magazine of claim 20 wherein the release surface engages an opposing release surface of the retention member and the opposing release surface is on a rear side of a transversely extending release arm of the retention member.

27. The staple magazine of claim 20 wherein the release member remains engaged with the retention member after disengagement of the lock surface from the opposing lock surface when the runner is in a latched position.

* * * * *